US006860299B2

(12) United States Patent
Kuji

(10) Patent No.: US 6,860,299 B2
(45) Date of Patent: Mar. 1, 2005

(54) INDUSTRIAL MULTILAYER TEXTILE

(75) Inventor: Takehito Kuji, Shizuoka (JP)

(73) Assignee: Nippon Filicon Co., Ltd., Tokyo (JP)

( * ) Notice: Subject to any disclaimer, the term of this patent is extended or adjusted under 35 U.S.C. 154(b) by 293 days.

(21) Appl. No.: 10/183,165

(22) Filed: Jun. 28, 2002

(65) Prior Publication Data

US 2003/0010393 A1 Jan. 16, 2003

(30) Foreign Application Priority Data

Jun. 29, 2001 (JP) ..... 2001-235564

(51) Int. Cl.[7] ..... D03D 13/00

(52) U.S. Cl. ..... 139/383 A; 139/383 R; 139/409; 139/410; 162/348; 442/203

(58) Field of Search ..... 139/383 R, 383 A, 139/409, 410; 162/348; 442/203

(56) References Cited

U.S. PATENT DOCUMENTS 3,230,136 A * 1/1966 Krake ..... 162/111
4,501,303 A 2/1985 Osterberg
4,564,052 A * 1/1986 Borel ..... 139/425 A
5,429,686 A * 7/1995 Chiu et al. ..... 139/383 A
5,487,414 A 1/1996 Kuji et al.
5,490,543 A 2/1996 Fujisawa
5,829,489 A 11/1998 Kuji
6,155,308 A 12/2000 Kuji
6,237,644 B1 * 5/2001 Hay et al. ..... 139/383 A
6,510,873 B2 * 1/2003 Nagura ..... 139/383 A
6,632,753 B1 * 10/2003 Beasley, Jr. ..... 442/203
6,649,026 B2 * 11/2003 Lamb ..... 162/348
6,684,911 B2 * 2/2004 Salway et al. ..... 139/383 A
6,706,152 B2 * 3/2004 Burazin et al. ..... 162/362

FOREIGN PATENT DOCUMENTS

JP H2-13072 4/1990

* cited by examiner

*Primary Examiner*—John J. Calvert
*Assistant Examiner*—Robert H. Muromoto, Jr.
(74) *Attorney, Agent, or Firm*—Rader, Fishman & Grauer PLLC

(57) ABSTRACT

An industrial multilayer textile has at least an upper surface side layer and a lower surface side layer as a running surface. The upper surface side layer and the lower surface side layer are connected by warp ground yarn connecting yarns that weave the upper surface side layer and the lower surface side layer. Among these, a pair of warp ground yarn connecting yarns is made into yarns corresponding to one warp in an upper surface side surface, and the pair of warp ground yarn connecting yarns and another warp are alternately disposed and woven with upper surface side wefts to form a surface of a substantially plain weave texture on the upper surface side layer.

14 Claims, 5 Drawing Sheets

FIG. 1

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 10' | | | × | | △ | ⊗ | | | × | | | × | | | × |
| 9' | | × | | × | | | × | | | | × | | △ | × | ○ |
| 8' | | | × | | | × | | △ | ⊗ | | | × | | | × |
| 7' | △ | × | ○ | | × | | × | | | × | | | | × | |
| 6' | | | × | | | × | | | × | | △ | ⊗ | | | × |
| 5' | | × | | △ | × | ○ | | × | | × | | | × | | |
| 4' | | | × | | | × | | | × | | | × | | △ | ⊗ |
| 3' | × | | | | × | | △ | × | ○ | | × | | × | | |
| 2' | | △ | ⊗ | | | × | | | × | | | × | | | × |
| 1' | × | | | × | | | | × | | △ | × | ○ | | × | |

FIG. 3

| | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| 10' | | | × | △ | | ⊗ | | | × | | | × | | | × |
| 9' | | × | | | × | | × | | | × | | | △ | × | ○ |
| 8' | | | × | | | × | | △ | ⊗ | | | × | | | × |
| 7' | △ | × | ○ | × | | | × | | | | × | | | × | |
| 6' | | | × | | | × | | | × | △ | | ⊗ | | | × |
| 5' | | × | | × | △ | ○ | | × | | | × | | × | | |
| 4' | | | × | | | × | | | × | | | × | | △ | ⊗ |
| 3' | × | | | × | | | △ | × | ○ | × | | | × | | |
| 2' | | △ | ⊗ | | | × | | | × | | | × | | | × |
| 1' | × | | | | × | | | × | | × | △ | ○ | | × | |

FIG. 4

| | 1 | 2 | 3 | 4 | 5 | 6 | 7 | 8 | 9 | 10 | 11 | 12 |
|---|---|---|---|---|---|---|---|---|---|---|---|---|
| 8' | | | × | | | × | | △ | ⊗ | △ | | × |
| 7' | | × | | × | | | × | | | | × | ○ |
| 6' | △ | | ⊗ | | △ | × | | | × | | | × |
| 5' | | × | | × | | ○ | | × | | × | | |
| 4' | | | × | | | × | △ | | ⊗ | | △ | × |
| 3' | × | | | | × | | | × | | × | | ○ |
| 2' | | △ | ⊗ | △ | | × | | | × | | | × |
| 1' | × | | | | × | ○ | × | | | | × | |

FIG. 5

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 16' | | × | | | × | | ○ | | × | | | | | × | ○ | |
| 15' | | | | × | | | | ⊗ | | | | × | | | | ⊗ |
| 14' | | × | | ○ | × | | | | × | | | ○ | | × | | |
| 13' | | | ○ | × | | | | × | | | ○ | × | | | | × |
| 12' | × | | | | × | △ | ○ | | | × | | | △ | × | ○ | |
| 11' | | | | × | | | | ⊗ | | | | × | | | | ⊗ |
| 10' | × | | | ○ | × | | | | | × | | ○ | | × | | |
| 9' | | △ | ○ | × | | | | × | △ | | ○ | × | | | | × |
| 8' | × | | | | | × | ○ | | | × | | | × | | ○ | |
| 7' | | | | × | | | | ⊗ | | | | × | | | | ⊗ |
| 6' | × | | | ○ | | × | | | | × | | ○ | × | | | |
| 5' | | | ○ | × | | | | × | | | ○ | × | | | | × |
| 4' | | × | | | △ | × | ○ | | × | | | | × | △ | ○ | |
| 3' | | | | × | | | | ⊗ | | | | × | | | | ⊗ |
| 2' | | × | | ○ | | × | | | × | | | ○ | × | | | |
| 1' | △ | | ○ | × | | | | × | | △ | ○ | × | | | | × |

FIG. 6

| | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| 8' | × | | | × | | × | | | × | | | × | | × | | | × | | × | |
| 7' | | △ | × | | × | | | × | | × | △ | | × | | × | | | × | | × |
| 6' | × | | | × | | | × | | × | | | × | | × | | × | | | × | |
| 5' | | | × | | × | △ | | × | | × | | | × | | × | | △ | × | | × |
| 4' | | × | | × | | | × | | × | | × | | | × | | × | | | × | |
| 3' | △ | | × | | × | | | × | | × | | △ | × | | × | | | × | | × |
| 2' | | × | | × | | × | | | × | | × | | | × | | | × | | × | |
| 1' | | | × | | × | | △ | × | | × | | | × | | × | △ | | × | | × |

PRIOR ART

INDUSTRIAL MULTILAYER TEXTILE

TECHNICAL FIELD OF THE INVENTION

The present invention relates to industrial textiles such as textiles for papering, conveyor belts, and filter cloths.

BACKGROUND OF THE INVENTION

Hitherto, as industrial textiles, textiles woven by warps and wefts are widely used, for example, they are used in many fields other than a papermaking fabric, a belt for conveyance, a filter cloth, and so on, and textile characteristics suitable for applications and use environments are required. In particular, the requirement in the wire for papering used in a papermaking step in which sucking of a material or the like is performed using a mesh of a textile, is severe, a textile superior in surfaceability in which no wire mark of the textile is transferred to a paper, besides, one having together a rigidity of a degree in which it can be suitably used even under a severe environment, and a textile which can keep, for a long period, conditions necessary for manufacturing a good paper, are requested. Other than these, fiber supportability, improvement of the retention of papermaking, good drainage performance, wear resistance, dimensional stability, running stability, and so on, are requested. Further, in recent years, since a paper machine is made higher in speed, attendant upon it, also the requirement to the wire for papering becomes further severer.

In this way, if the textile for papering in which the requirement is severe among industrial textiles is described, since the requirement and its solution of most of the industrial textiles can be understood, hereinafter, the present invention representative of the papermaking fabric will be described.

For example, if the papermaking speed becomes a high speed, the sucking speed inevitably becomes a high speed, and there is a necessity of making the sucking power strong. By it, since cast-off of fibers, fillers, or the like, and generation of wire marks naturally become remarkable, further improvement of fiber supportability and surfaceability becomes necessary. If intrusion of a wet paper in the papermaking fabric becomes large, or sticking of a fiber is generated, also a problem that the wet paper exfoliation in case of transferring the wet paper to a felt becomes bad, arises. It is because, since the wet paper remaining on the textile and formed is, by the sucking power, pressed onto the textile upper surface, in the portion where a yarn is present, the yarn intrudes the wet paper, inversely, between meshes where no yarn is present, the wet paper intrudes the mesh and a mark of the yarn and mesh is generated on the wet paper surface. Although completely eliminating wire marks is impossible, for making this as small as possible and inconspicuous, the upper layer surface of the textile is made fine, and improvement of the surface smoothness and fiber supportability must be intended. However, since a fine mesh textile regarding the surfaceability and fiber supportability as important is fundamentally woven by yarns whose line diameters are small, it was inferior in wear resistance.

Furthermore, since the papermaking fabric runs at a high speed, on the running surface side on the side coming into contact with a machine, by friction with a roll or the like, a phenomenon that the textile gradually wears is observed, and there is also a case that the life ends the wear. To improve the wear resistance, various measures in which the textile texture is made into a texture of a weft wear type, or the material of the yarn is changed, are needed, in particular, a method of giving the wear resistance by using a yarn whose line diameter is large, or the like, is used in general. However, in the yarn whose line diameter is large, although the wear resistance is improved, it was difficult to obtain a superior surfaceability.

To solve both problems of the surfaceability and wear resistance, using two textiles constructed using different warps and wefts respectively in the upper surface side layer and the running surface side layer, a two-layer textile in which the textiles in both layers are united by connecting yarns has been used. In this method, there was an effect that the textile in accordance with the performance respectively required can be adopted. In the upper surface side layer, using warps and wefts small in line diameter, a fine upper layer surface was formed, and in the running surface side layer, using warps and wefts large in line diameter, a running surface large in wear resistance was formed. For the connecting yarns, in order not to decrease the surfaceability, in general, yarns of smaller diameter than the upper surface side warps and the upper surface side wefts were used. In the upper surface side layer texture, to form a fine surface, although, in many cases, plain weave is used, in practice, since the connecting yarns for weaving together the two layers are used, substantially, a surface in which the connecting yarns are disposed here and there on the plain weave surface is formed. Since, in the connecting yarns, portions appearing on the surface are also present, from the problem of the surface smoothness, it was not preferable to use yarns so large in line diameter.

Although, in many cases, as the textile for normal papermaking, a tension is applied in a warp direction, since the yarn in the warp direction is in a state that the tension is always applied, there is hardly a case that, by running of the textile, the warp is loosened and moves, on the other hand, in the connecting yarns which are, in many cases, disposed between wefts from the problems such as the weaveability and fiber supportability, if the tension is applied, it elongates or the connecting yarn is crumpled between the upper surface side textile and the running surface side textile and internal wear is generated, there is a case that a problem that a gap is generated between the textiles or separated arises. The internal wear is well observed in a connecting yarn small in line diameter and low in strength, used for improving the surfaceability. The connecting yarn cross-links with a yarn in the upper surface side layer for connecting the two textiles, since the yarn is drawn in by the connecting force, there was a problem that a concave is given to the upper surface side surface and the surfaceability of the textile is deteriorated.

Therefore, a development of a textile using a warp ground yarn connecting yarn in which the upper surface side layer and the running surface side layer are woven together with forming the upper surface side surface between the warps, has been made. As one example of this prior art, in Patent Publication No. 2-13072, an example of a two-layer textile characterized in that, even with connecting two layers of textiles by a set of two, it appears on a surface as one warp, and with a plurality of upper surface side warps, a plain weave texture is formed on the upper surface side surface, is shown in FIG. 1.

In this two-layer textile, since warp ground yarn connecting yarns are disposed in a set of two between warps to weave together the upper and lower two layers, although it is superior in connecting force, two knuckles of the warp ground yarn connecting yarn and the upper surface side warp are mixedly present, from the difference in texture or line diameter, or line material, of two vertical yarns, since the height of the knuckle of the upper surface side weft is different, it was impossible to form a smooth surface.

SUMMARY OF THE INVENTION

In the present invention, by performing a study of a cause of the prior art in which a uniform surface could not be obtained, and solving the problem, a two-layer textile superior in surfaceability which could not be made hitherto, and superior in connecting force, could be provided.

The present invention is in view of the above problem and to provide an industrial multilayer textile in which an upper surface side layer and a running surface side layer are connected and warp ground yarn connecting yarns forming part of an upper surface side surface are disposed in a set of two between upper surface side warps so as to form a plain weave texture corresponding to substantially one warp on a surface, by forming a plain weave surface by warp ground yarn connecting yarns disposed in a set of two, upper surface side warps, and upper surface side wefts, it is superior in fiber supportability and connecting force, by making into a structure in which a knuckle of either one of an upper surface side warp or a warp ground yarn connecting yarn is present on one upper surface side weft, only by changing the line material of each yarn, another condition, or the like, a smooth surface can be given.

The present invention relates to an industrial multilayer textile comprising at least an upper surface side layer and a lower surface side layer as a running surface. The upper surface side layer and the lower surface side layer are connected by warp ground yarn connecting yarns that weave the upper surface side layer and the lower surface side layer. Among these, a pair of warp ground yarn connecting yarns is made into yarns corresponding to one warp in an upper surface side surface, and the pair of warp ground yarn connecting yarns and another warp are alternately disposed and woven with upper surface side wefts to form a surface of a substantially plain weave texture on the upper surface side layer.

The upper surface side wefts of the industrial multilayer textile may comprise a first upper surface side weft that passes only over the upper surface side warp to form a knuckle on the upper surface side of the textile, and a second upper surface side weft that passes only over the pair of warp ground yarn connecting yarns to form a knuckle on the upper surface side, and the first upper surface side weft and the second upper surface side weft may be alternately disposed.

The upper surface side warp and the warp ground yarn connecting yarn may be different in material. Further, the pair of warp ground yarn connecting yarns may be in the same texture. Additionally, one of the pair of warp ground yarn connecting yarns may pass under a lower surface side weft on the lateral side of a position where a lower surface side warp passes under the lower surface side weft.

At least one of the pair of warp ground yarn connecting yarns may be a warp ground yarn connecting yarn passing over one upper surface side weft to form a knuckle on the upper surface side, passing between the next one upper surface side weft and a lower surface side weft, passing over the next one upper surface side weft to form a knuckle on the upper surface side, passing between the next two upper surface side wefts and the lower surface side wefts, and then, after passing under one lower surface side weft, passing between two upper surface side wefts and the lower surface side wefts.

One of the pair of the warp ground yarn connecting yarns in a pair may be the one passing over one upper surface side weft to form a knuckle on the upper surface side, passing between a next upper surface side weft and a lower surface side weft, passing over the next one upper surface side weft to form a knuckle on the upper surface side, passing between the next three upper surface side wefts and the lower surface side wefts, and then, after passing under one lower surface side weft, passing between three upper surface side wefts and the lower surface side wefts. In this case, the other one of the pair of the warp ground yarn connecting yarn may be the one passing over one upper surface side weft to form a knuckle on the upper surface side, passing between the next one upper surface side weft and the lower surface side weft, passing over another one upper surface side weft to form a knuckle on the upper surface side, passing between the next one upper surface side weft and the lower surface side weft, passing again over the next one upper surface side weft to form a knuckle on the upper surface side, passing between the next two upper surface side wefts and the lower surface side wefts, and then, after passing under one lower surface side weft, passing between two upper surface side wefts and the lower surface side wefts.

In addition, wherein each of the pair of the warp ground yarn connecting yarns may be disposed in two different weaving patterns alternately.

BRIEF DESCRIPTION OF THE INVENTION

FIG. 1 is a repeating unit design view showing a complete texture of an example 1 of the present invention.

FIG. 3 is a repeating unit design view showing a complete texture of another example 1 of the present invention.

FIG. 4 is a repeating unit design view showing a complete texture of another example 1 of the present invention.

FIG. 5 is a repeating unit design view showing a complete texture of another example 1 of the present invention.

FIG. 6 is a repeating unit design view showing a complete texture of a prior art.

PREFERRED EMBODIMENT OF THE INVENTION

Figure 2A:
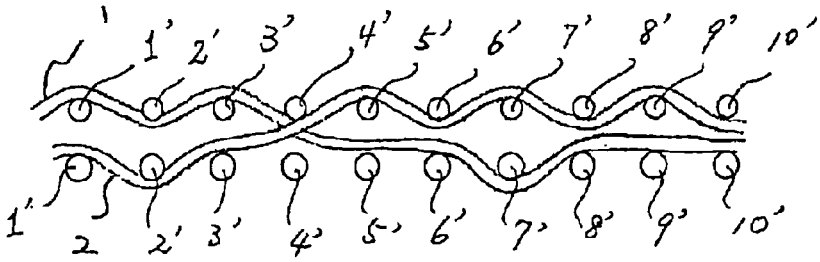
FIGS. 2A through 2J are cross section views along each of the warps shown in FIG. 1.

An industrial textile of the present invention is used as an industrial textile such as a papermaking fabric, a conveyor belt, or a filter cloth, in particular, it can be suitably used also as a papermaking fabric in which the requirement from a user is severe.

The present invention is a textile which has at least an upper surface side layer and a running surface side layer and in which a plain weave corresponding to one warp is formed by one set of two warp ground yarn connecting yarns alternately appearing on the upper surface side surface, and further, the upper surface side layer surface is made into a plain weave structure by one set of two warp ground yarn connecting yarns, an upper surface side warp, and an upper surface side weft, it is superior in fiber supportability and connecting force, and by making into a structure in which either one knuckle of the warp ground yarn connecting yarns is present on one upper surface side weft, only by changing the line material, another condition, or the like, of each yarn, a smooth surface can be given.

In a conventional multilayer textile, in the connecting yarn connecting two textiles, the connecting yarn of a diameter in a degree which does not give an influence of a protrusion or the like upon the upper surface side surface in which the line diameter is smaller than the upper surface side warp and weft, was used. Therefore, the connecting strength was small, if the connecting yarns which, in many cases, were disposed between wefts, received a tension between the textiles, it elongated and loosening was generated, and thereby internal friction was generated, or there is a case that the textile shifted and the drainage performance deteriorated. Even if it were a small-diameter connecting yarn small in connecting force, since it connected two textiles, when it passed over a yarn in the upper surface side layer and then dived on the lower side, a concave was generated on the textile surface where the connecting yarn appeared on the surface, and there was a case that a wire mark was given to a paper.

Therefore, in the multilayer textile of the present invention, by disposing one set of two warp ground yarn connecting yarns connecting the upper surface side layer and the running surface side layer, and forming part of the upper surface side surface like the upper surface side warp, the connecting force was improved, the generation of the concave on the textile surface was prevented. One set of two warp ground yarn connecting yarns is made to function as one warp on the textile surface, and a plain weave was formed on the upper surface side surface by the one set of warp ground yarn connecting yarns, the upper surface side warp, and the upper surface side weft. By making the upper surface side layer into a plain weave texture, since the number of fiber support points was increased, the fiber supportability was improved, and since the texture became fine, there was an effect that it is superior also in surface smoothness.

The first effect by using the warp ground yarn connecting yarn, is that, differently from a conventional connecting yarn which only connects and does not take part in surface formation, since the warp ground yarn connecting yarn forms the plain weave as part of the textile surface, there is no generation of the local concave. Since the warp ground yarn connecting yarn is used in a state that a tension is always applied thereto in a warp direction, that is, a running direction called in general, any generation of loosening of the yarn does not occur, and also in view of the textile structure, there is a tendency that the connecting force of the warp ground yarn connecting yarn is stronger than that of the connecting yarn disposed in a weft direction. In addition, in the textile of the present invention, since one set of two warp ground yarn connecting yarns was disposed in a warp direction, its connecting force became very superior one.

Furthermore, since the textile of the present invention was a texture in which a plain weave was formed on the upper surface side surface by the warp ground yarn connecting yarns disposed in one set of two, the upper surface side warp, and the upper surface side weft, it was superior in fiber supportability, and it became a textile on which there is no local concave.

In the upper surface side layer, since the upper surface side warp and the warp ground yarn connecting yarns disposed in one set of two forming the texture substantially corresponding to one warp are that one upper surface side warp and one set of warp ground yarn connecting yarns are alternately disposed to form a plain weave, in the upper surface side weft, the weft which forms a knuckle on the warp ground yarn connecting yarn and the weft which forms a knuckle on the upper surface side warp are alternately disposed. That is, the first upper weft which forms the knuckle only with the upper side of the warp and the second upper weft which does not form a knuckle over the upper surface side warp but forms the knuckle only over the ground yarn connecting yarn, are present. If it is made into such a structure, by controlling the line material, textile tension, or the like, by each yarn of the warp ground yarn connecting yarn, upper surface side warp, first upper surface side weft, and second upper surface side weft, the heights of the knuckles of all yarns can be made substantially the same, and a smooth surface can be formed.

The textures of the warp ground yarn connecting yarns disposed in one set of two may be the same or different. As an example in which the two warp ground yarn connecting yarns are the same texture, there is one formed by combining two warp ground yarn connecting yarns of a texture in which one set of two warp ground yarn connecting yarns passes over one upper surface side weft and forms a knuckle on the upper surface side, passes between one upper surface side weft and the running surface side weft, that is, under one upper surface side weft, passes over one upper surface side weft and forms a knuckle on the upper surface side, passes between the next two upper surface side wefts and the running surface side weft, and then, passes under one running surface side weft, and passes between two upper surface side wefts and the running surface side wefts.

In addition, as an example in which one set of two warp ground yarn connecting yarns forms different textures, one having a texture in which one of the one set of two warp ground yarn connecting yarns passes over one upper surface side weft and forms a knuckle on the upper surface side, passes between the next one upper surface side weft and the lower surface side weft, passes over the next one upper surface side weft and forms a knuckle on the upper surface side, passes between the next three upper surface side wefts and the running surface side wefts, passes on the lower side on one running surface side weft, and passes between the next three upper surface side wefts and the running surface side wefts, a textile in which the other one warp ground yarn connecting yarn passes over one upper surface side weft and forms a knuckle on the upper surface side, passes between the next one upper surface side weft and the running surface side weft, and then, passes over one upper surface side weft and forms a knuckle on the upper surface side, passes between the next upper surface side weft and the running surface side weft, and then, passes over one upper surface side weft and forms a knuckle on the upper surface side, passes between the next two upper surface side wefts and the running surface side wefts, and, after passing under one running surface side weft, passes between two upper surface side wefts and the running surface side wefts, a texture in which both of these textures are combined and a plain weave corresponding to one warp is formed on the upper surface side surface, other than this, a texture in which a plain weave is formed on the upper surface side layer surface by one set of two warp ground yarn connecting yarns, and the upper surface side layer and the running surface side layer are connected, and either one of the warp ground yarn connecting yarn or the upper surface side warp forms a single knuckle on the upper side on one upper surface side weft, may be, and it is not limited to the above textures. For example, a set in which two warp ground yarn connecting yarns are the same texture and a set of different textures may be alternately disposed, and other than this, in one set of warp ground yarn connecting yarns comprising a combination of different textures, there is a texture in which warp ground yarn connecting yarns are combined inversely in left and right per one set.

As for the upper surface side warp, a plain weave texture passing over one upper surface side weft and then under the upper surface side weft is formed.

It is preferable that at least one of warp ground yarn connecting yarns of two pairs of warp ground yarn connecting yarns disposed adjacent to, or both sides of, an upper surface side warp passes under a running surface side weft at a position adjacent to, or lateral to, where a lower surface side warp, that is disposed under the upper surface side warp, passes under the same running surface side weft, since the connecting force and wear resistance can be improved.

Although the texture of the running surface side layer is not particularly limited, a texture of a weft wear type is preferable. For example, in a five-shaft texture, a running surface side warp passes over one running surface side weft after the running surface side weft passes under four running surface side warps may be used. By shifting each of weft positions at constant repeating cycles, the weft wear type texture for the running surface side layer in which each of running surface side wefts passes under one running surface side weft, after passing over four running surface side wefts.

Although the yarn used of the present invention may be selected based on application or use, for example, other than a monofilament, a multifilament, a span yarn, a processed yarn generally called a textured yarn, a bulky yarn, or a stretch yarn, to which a burring process, a bulky process, or the like, is applied, or a yarn in which these are combined by twining or the like, can be used. As for the sectional shape of the yarn, a rectangular yarn such as a tetragon or a star, or a yarn such as elliptic or hollow, can be used. As for the material, it can be freely selected, and polyester, nylon, polyphenylene sulfide, polyvinylidene fluoride, polypro, aramide, polyether ether ketone, polyethylene terephthalate, polytetrafluoroethylene, cotton, wool, metal, or the like, can be used. Of course, a copolymer or a yarn in which various substances are blended or contained in these materials in accordance with objects, may be used.

As a papermaking fabric, in general, in the upper surface side warp, running surface side warp, and upper surface side weft, it is preferable to use a polyester monofilament having rigidity and superior in dimensional stability. As the warp ground yarn connecting yarn, it is preferable to use a polyester monofilament like the upper surface side warp. The kinds of the upper surface side warp and the warp ground yarn connecting yarn may be the same or different, and it can be selected upon occasion from the nature of the textile, weaveability, or the like. However, since the roles of the upper surface side warp and the warp ground yarn connecting yarn are different, it is preferable to use different yarns. As for the upper surface side weft, since the first upper surface side warp passing over the upper surface side warp and the second upper surface side weft passing over the warp ground yarn connecting yarn are present, there is a case that the heights of the formed knuckles, or the like, are different. At that time, by using different yarns for the first upper surface side weft and second upper surface side weft, or changing the other conditions, it can be solved.

For the running surface side weft for which wear resistance is required, alternately disposing a polyester monofilament and a nylon monofilament, or the like, cross-weaving is preferable because the wear resistance can be improved with ensuring rigidity.

EXAMPLES

The present invention will be described based on examples with reference to drawings.

FIG. 1 is a design view showing a complete texture of an example of the present invention. FIG. 1 is an example of the present invention, and one of examples of textiles in which a plain weave surface is formed using a pair of or one set of two warp ground yarn connecting yarns.

The complete texture is a technical term meaning a minimum repetition unit of a textile texture, and this complete texture connects upward, downward, leftward, and rightward to form the texture of the whole of the textile.

In the design view, a warp and a warp ground yarn connecting yarn are shown by Arabic numerals, for example, 1, 2, and 3, and wefts in the upper surface side and running surface side are shown by Arabic numerals to which primes are annexed, for example, 1', 2', and 3'.

An x mark in a box indicates that an upper surface side warp or warp ground yarn connecting yarn is positioned over an upper surface side weft, a ○ mark in a box indicates that a running surface side warp is positioned under a running surface side weft, and a Δ mark in a box indicates that a warp ground yarn connecting yarn is positioned under a running surface side weft. A blank box indicates that a warp ground yarn connecting yarn, upper surface side warp and running surface side warp are positioned between an upper surface side weft and a running surface side weft.

Although the upper surface side warp and the running surface side warp, and the upper surface side weft and the running surface side weft are disposed with overlapping up and down for convenience's sake in the design view, as for an actual textile, there is a case that they are disposed with laterally shifting.

Example 1

In the design view of FIG. 1, numerals 3, 6, 9, 12, and 15 denote upper surface side warps and running surface side warps that the upper surface side warps are disposed above the running surface side warps. Between the upper surface side warps and between running surface side warps, warp ground yarn connecting yarns are disposed in one set of two as 1 and 2, 4 and 5, 7 and 8, 10 and 11, and 13 and 14. Numerals with primes 1', 2', 3', 4', 5', 6', 7', 8', 9', and 10' denote wefts. Of these wefts, odd numbered upper surface side wefts 1', 3', 5', 7', and 9' are first upper surface side wefts that pass under a warp ground yarn connecting yarn at a place shown with an x mark and do not pass under an upper surface side weft. Even numbered upper surface side wefts 2', 4', 6', 8', and 10' are second upper surface side wefts that pass under an upper surface side warp at a place shown with an X mark and do not pass under a warp ground yarn connecting yarn. The upper surface side wefts are disposed over the running surface side weft.

On the upper surface side surface, each of sets of two warp ground yarn connecting yarns 1 and 2, 4 and 5, 7 and 8, 10 and 11, and 13 and 14 forms a plain weave corresponding to one warp with the upper surface side weft, the upper surface side warp adjacent to it also forms a plain weave with the upper surface side weft, and the upper surface side surface forms the plain weave by two kinds of yarns in a vertical direction and the weft.

In this example, although the warp ground yarn connecting yarns 1, 2, 4, 5, 7, 8, 10, 11, 13 and 14 form the plain weave on the textile surface, they weave the upper surface side layer textile and the running surface side layer textile. For example, where warp ground yarn connecting yarns 1, 4, 7, 10 and 13 form the plain weave in the upper surface side layer at the places of the x marks, the other warp ground yarn connecting yarns 2, 5, 8, 11 and 14 are disposed under running surface side wefts at the places of the Δ marks so as to connect the running surface side textile.

Concretely, each of the ground yarn connecting yarns 1, 4, 7, 10 and 13 passes over one upper surface side weft at the to form a knuckle on the upper surface side at an X mark, passes between one upper surface side weft and the running surface side weft shown as a blank box, subsequently, passes over another upper surface side weft to form a knuckle on the upper surface side at an X mark, after passing between the next three upper surface side wefts and the running surface side wefts at the places shown as three consecutive blank boxes, passes under one running surface side weft at a Δ mark, and then passes between three upper surface side wefts and the running surface side wefts at the places shown as consecutive three blank boxes. Each of the ground yarn connecting yarns 2, 5, 8, 11 and 14 passes over one upper surface side weft at the to form a knuckle on the upper surface side at an X mark, passes between one upper surface side weft and the running surface side weft shown as a blank box, subsequently, passes over another upper surface side weft to form a knuckle on the upper surface side at an x mark, passes between one upper surface side weft and the running surface side weft shown as a blank box, subsequently, passes over another upper surface side weft to form a knuckle on the upper surface side at an X mark, after passing between the next two upper surface side wefts and the running surface side wefts at the places shown as two consecutive blank boxes, passes under one running surface side weft at a Δ mark, and then passes between two upper surface side wefts and the running surface side wefts at the places shown as consecutive two blank boxes as described in FIG. 1. By combining and disposing the warp ground yarn connecting yarns of these two textures, a plain weave corresponding to one warp is formed on the upper surface side surface.

Moreover, as understood by viewing FIG. 1, the first upper surface side wefts 1', 3', 5', 7' and 9' pass only over the upper surface side warps 3, 6, 9, 12 and 15 to form the knuckles on the surface, and the second upper surface side wefts 2', 4', 6', 8' and 10' passing only over the warp ground yarn connecting yarns 1 and 2, 4 and 5, 7 and 8, 10 and 11, and 13 and 14, each disposed in pair, to form the knuckles on the upper surface. The first and second wefts are alternately disposed. Since each of these wefts always passes on the same kind of yarn in a vertical direction of either one of the warps or the ground yarn connecting yarns to form the knuckle on the textile surface, although there is a case that the heights or the like of the knuckles are different, by controlling the line material or the weave tension by each yarn of the first upper surface side weft and yarn of the second upper surface side weft, the heights of the knuckles of all yarns can be made substantially the same, and a smooth surface can be formed.

More detailed explanation will be made in relation to FIGS. 1, and 2A through 2J. The warp ground yarn connecting yarn 1 of FIGS. 1 and 2A is a texture in which it passes over the upper surface side weft 1', passes between the upper surface side weft 2' and the running surface side weft 2', subsequently, passes over one upper surface side weft 3', passes between three upper surface side wefts 4', 5', and 6' and the running surface side wefts 4', 5', and 6', and passes under one running surface side weft 7', and passes between three upper surface side wefts 8', 9', and 10' and the running surface side wefts 8', 9', and 10'. The other warp ground yarn connecting yarn 2, that forms a pair with the warp ground yarn connecting yarn 1, passes between one upper surface side weft 1' and the lower surface side weft 1', passes under one running surface side weft 2', passes between two upper surface side wefts 3' and 4' and the running surface side wefts 3' and 4', passes over one upper surface side weft 5', passes between one upper surface side weft 6' and the running surface side weft 6', again passes over one upper surface side weft 7', passes between one upper surface side weft 8' and the running surface side weft 8', passes over one upper surface side weft 9', and passes between two upper surface side wefts 10' and 1' (of adjacent repeating unit), which belongs to adjacent repeating unit, and the running surface side weft 10' and 1' (of adjacent repeating unit). That is, where one of the two warp ground yarn connecting yarns 1 and 2 forms a plain weave in the upper surface side layer, the other warp ground yarn connecting yarn connects the running surface side textile at the places marked Δ.

Furthermore, one upper surface side warp adjacent to one set of warp ground yarn connecting yarns appears alternately with the upper surface side weft on the upper surface side surface at the places marked X blank to form a plain weave.

The running surface side textile is preferably a weft wear type textile, in which many wefts appear on the running surface side surface. The textile is formed into an endless textile with well-known joining method by joining two running direction ends of the textile. In many cases, the textile runs in a warp direction. Since tension is applied to the textile in the warp direction, yarns of the textile in the weft direction are required more wear resistance so that the textile can keep long life. Even in the weft wear type texture, a portion where the lower layer surface side warp appears on the running surface side surface is present, a part where the warp ground yarn connecting yarn also appears on the running surface side surface. Since one set of two warp ground yarn connecting yarns is disposed, there is a tendency that the line diameter may be smaller than the running surface side warp, and the wear limit may be smaller than the running surface side warp. To make the influence of the wear as smaller than it as possible, it may be made into such a structure that the running surface side knuckle of the warp ground yarn connecting yarn is disposed adjacent to the running surface side knuckle of the running surface side warp.

Figure 2B:
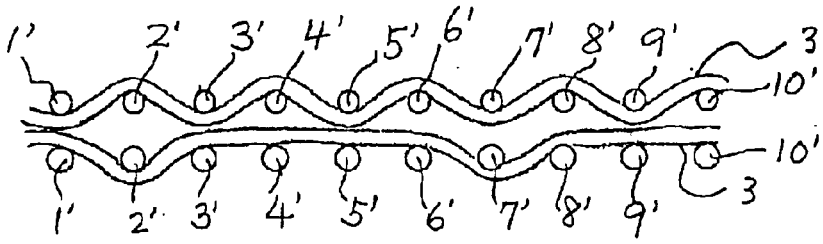

Concretely, in the example of FIG. 1 and as shown in FIG. 2B, the running surface side warp 3 passes under the running surface side wefts 2' and 7' shown with the mark ○. And, at the left lateral or adjacent places of the running surface side knuckles at the running surface side wefts 2' and 7' shown with the marks ○, running surface side knuckles of the warp ground yarn connecting yarns 2 and 1 are present as shown in the marks Δ at the running surface side wefts 2' and 7' respectively.

Figure 2C:
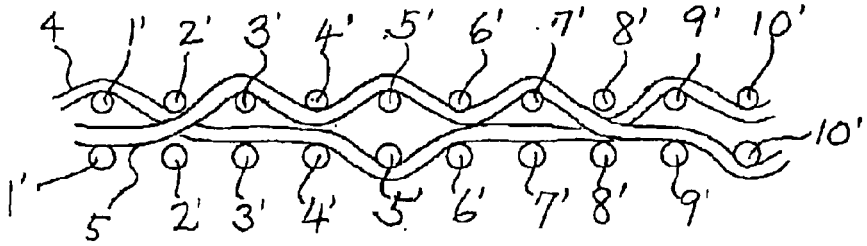

The warp ground yarn connecting yarn 4 of FIGS. 1 and 2C is a texture in which it passes over one upper surface side weft 1', passes between three upper surface side wefts 2', 3', and 4' and the running surface side wefts 2', 3', and 4', and passes under one running surface side weft 5', and passes between three upper surface side wefts 6', 7', and 8' and the running surface side wefts 6', 7', and 8', subsequently passes over the upper surface side weft 9', passes between the upper surface side weft 10' and the running surface side weft 10'. The other warp ground yarn connecting yarn 5, that forms a pair with the warp ground yarn connecting yarn 4, passes between two upper surface side wefts 1' and 2' and the running surface side wefts 1' and 2', passes over one upper surface side weft 3', passes between one upper surface side weft 4' and the running surface side weft 4', again passes over one upper surface side weft 5', passes between one upper surface side weft 6' and the running surface side weft 6', passes over one upper surface side weft 7', and passes between two upper surface side wefts 8' and 9' the running surface side wefts 8' and 9', and passes under one running surface side weft 10'. That is, where one of the two warp ground yarn connecting yarns 4 and 5 forms a plain weave in the upper surface side layer, the other warp ground yarn connecting yarn connects the running surface side textile at the places marked Δ in FIG. 1 (at running side wefts 5' and 10' of FIG. 2C).

Figure 2D:
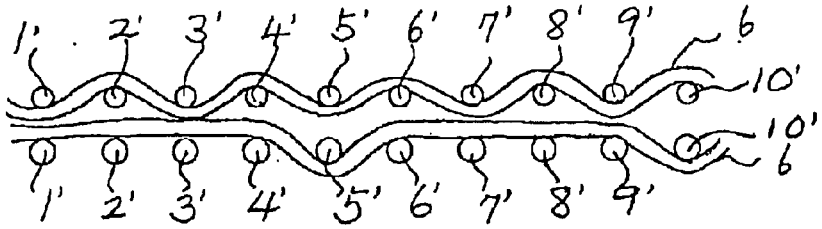

As shown in FIGS. 1 and 2D, the running surface side warp 6 passes under the running surface side wefts 5' and 10' (shown with the mark ○ in FIG. 1). And, at the left lateral or adjacent places of the running surface side knuckles at the running surface side wefts 5' and 10' (shown with the marks ○ in FIG. 1), running surface side knuckles of the warp ground yarn connecting yarns 4 and 5 are present as shown in the marks Δ at the running surface side wefts 5' and 10' respectively (see FIGS. 1 and 2C).

Figure 2E:
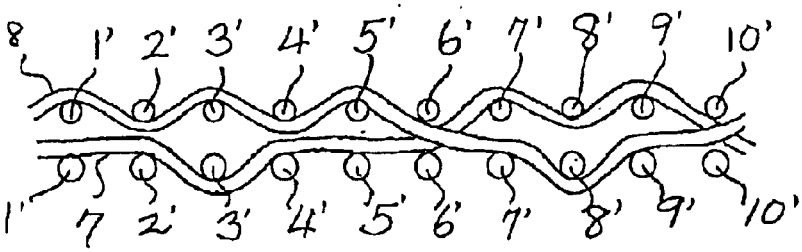

The warp ground yarn connecting yarn 7 of FIGS. 1 and 2E is a texture in which it passes between three upper surface side wefts 10' (of adjacent repeating unit), 1', and 2' and the running surface side wefts 10' (of adjacent repeating unit), 1', and 2', and passes under one running surface side weft 3', and passes between three upper surface side wefts 4', 5', and 6' and the running surface side wefts 4', 5', and 6', subsequently passes over the upper surface side weft 7', passes between the upper surface side weft 8' and the running surface side weft 8', passes over one upper surface side weft 9' and passes between three upper surface side wefts including the upper surface side weft 10' and, within the adjacent repeating unit, two upper surface side wefts 1', and 2' and the running surface side wefts including the lower surface side weft 10' and, within the adjacent repeating unit, two lower surface side wefts 1', and 2'. The other warp ground yarn connecting yarn 8, that forms a pair with the warp ground yarn connecting yarn 7, passes over one upper surface side weft 1', passes between one upper surface side weft 2' and the running surface side weft 2', again passes over one upper surface side weft 3', passes between one upper surface side weft 4' and the running surface side weft 4', passes over one upper surface side weft 5', and passes between two upper surface side wefts 6' and 7' the running surface side wefts 6' and 7', passes under one running surface side weft 8' and passes between two upper surface side wefts 9' and 10' and the running surface side wefts 9' and 10'. That is, where one of the two warp ground yarn connecting yarns 7 and 8 forms a plain weave in the upper surface side layer, the other warp ground yarn connecting yarn connects the running surface side textile at the places marked Δ in FIG. 1 (at running side wefts 3' and 8' of FIG. 2E).

Figure 2F:
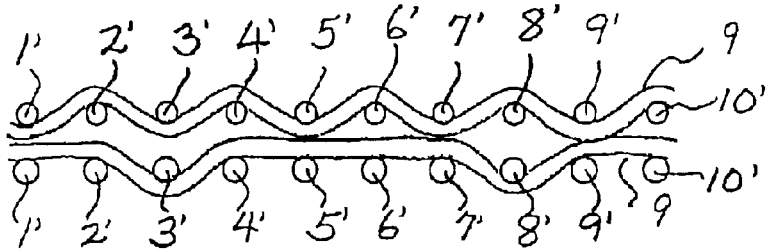

As shown in FIGS. 1 and 2F, the running surface side warp 9 passes under the running surface side wefts 3' and 8' (shown with the mark ○ in FIG. 1). And, at the left lateral or adjacent places of the running surface side knuckles at the running surface side wefts 3' and 8' (shown with the marks ○ in FIG. 1), running surface side knuckles of the warp ground yarn connecting yarns 7 and 8 are present as shown in the marks Δ at the running surface side wefts 3' and 8' respectively (see FIGS. 1 and 2E).

Figure 2G:
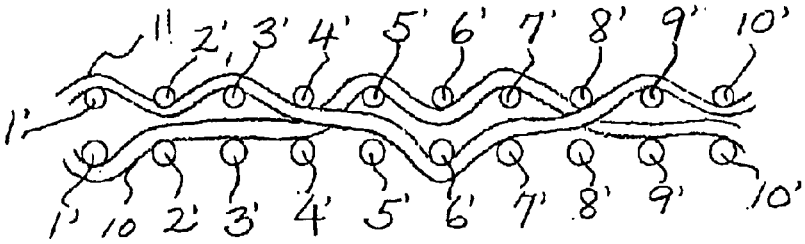

The warp ground yarn connecting yarn 10 of FIGS. 1 and 2G is a texture in which it passes under one running surface side weft 1', and passes between three upper surface side wefts 2', 3', and 4' and the running surface side wefts 2', 3', and 4', subsequently passes over the upper surface side weft 5', passes between the upper surface side weft 8' and the running surface side weft 6', passes over one upper surface side weft 7' and passes between three upper surface side wefts 8', 9' and 10' and three running surface side wefts 8', 9' and 10'. The other warp ground yarn connecting yarn 11, that forms a pair with the warp ground yarn connecting yarn 10, passes over one upper surface side weft 1', passes between one upper surface side weft 2' and the running surface side weft 2', passes over one upper surface side weft 3', and passes between two upper surface side wefts 4' and 5' the running surface side wefts 4' and 5', passes under one running surface side weft 6' and passes between two upper surface side wefts 7' and 8' and the running surface side wefts 7' and 8', passes over one upper surface side weft 9', passes between one upper surface side weft 10' and the running surface side weft 10'. That is, where one of the two warp ground yarn connecting yarns 10 and 11 forms a plain weave in the upper surface side layer, the other warp ground yarn connecting yarn connects the running surface side textile at the places marked Δ in FIG. 1 (at running side wefts 1' and 6' of FIG. 2G).

Figure 2H:
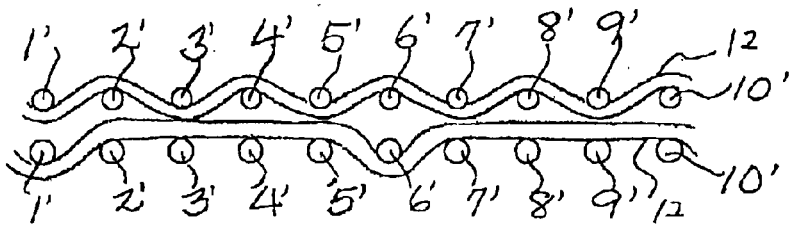

As shown in FIGS. 1 and 2H, the running surface side warp 12 passes under the running surface side wefts 1' and 5' (shown with the mark ○ in FIG. 1). And, at the left lateral or adjacent places of the running surface side knuckles at the running surface side wefts 1' and 5' (shown with the marks ○ in FIG. 1), running surface side knuckles of the warp ground yarn connecting yarns 10 and 11 are present as shown in the marks Δ at the running surface side wefts 1' and 5' respectively (see FIGS. 1 and 2G).

Figure 2I:
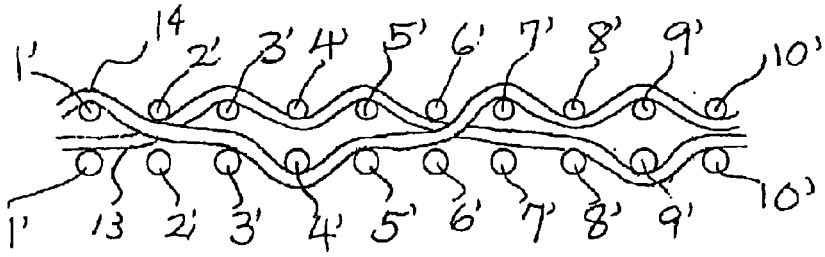

The warp ground yarn connecting yarn 13 of FIGS. 1 and 2I is a texture in which it passes between three upper surface side wefts 10' (of adjacent repeating unit), 1', and 2' and the running surface side wefts 10' (of adjacent repeating unit), 1', and 2', subsequently passes over the upper surface side weft 3', passes between the upper surface side weft 4' and the running surface side weft 4', passes over one upper surface side weft 5', passes between three upper surface side wefts 6', 7' and 8' and three running surface side wefts 6', 7' and 8', passes under the running surface side weft 9' and passes between three consecutive upper surface side wefts including the upper surface side weft 10" and three running surface side wefts including running surface side weft 10'. The other warp ground yarn connecting yarn 14, that forms a pair with the warp ground yarn connecting yarn 13, passes over one upper surface side weft 1', and passes between two upper surface side wefts 2' and 3' the running surface side wefts 2' and 3', passes under one running surface side weft 4' and passes between two upper surface side wefts 5' and 6' and the running surface side wefts 5' and 6', passes over one upper surface side weft 7', passes between one upper surface side weft 8' and the running surface side weft 8', passes over one upper surface side weft 9', and passes between one upper surface side weft 10' and the running surface side weft 10'. That is, where one of the two warp ground yarn connecting yarns 13 and 15 forms a plain weave in the upper surface side layer, the other warp ground yarn connecting yarn connects the running surface side textile at the places marked Δ in FIG. 1 (at running side wefts 4' and 9' of FIG. 2I).

Figure 2J:
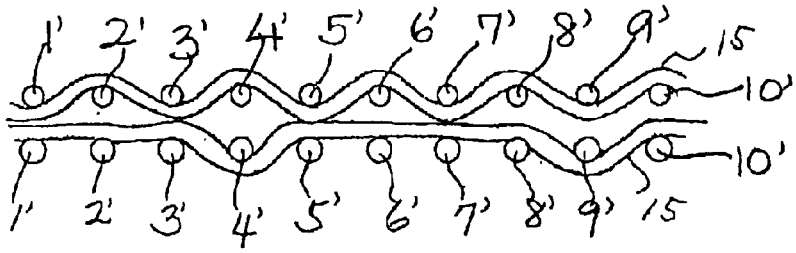

As shown in FIGS. 1 and 2J, the running surface side warp 15 passes under the running surface side wefts 4' and 9' (shown with the mark ○ in FIG. 1). And, at the left lateral or adjacent places of the running surface side knuckles at the running surface side wefts 4' and 9' (shown with the marks ○ in FIG. 1), running surface side knuckles of the warp ground yarn connecting yarns 14 and 15 are present as shown in the marks Δ at the running surface side wefts 4' and 9' respectively (see FIGS. 1 and 2I).

Example 2

FIG. 3 showed another example of the present invention. The warp and weft of FIG. 3 are disposed in the same manner as those of Example 1, except for the one in which the order of one set of warp ground yarn connecting yarns is made alternate. In FIG. 1, the warp ground yarn connecting yarns in a pair of two different textures are present, each one of the warp ground yarn connecting yarns 1, 4, 7, 10 and 13 forms two knuckles on the upper layer surface (shown with marks of X), the other ones 2, 5, 8, 11 and 14 forms three knuckles (shown with marks of X), and those are disposed in the same order. However, in FIG. 3, the order of the first and second warp ground yarn connecting yarns are alternately changed or inversed, in that, first warp ground yarn connecting yarn of first pair forms two knuckles on the upper layer surface (e.g. the warp ground yarn connecting yarn 1) and second warp ground yarn connecting yarn of the first pair forms three knuckles (e.g. the warp ground yarn connecting yarn 2), and ground yarn connecting yarns of second pair (e.g. the warp ground yarn connecting yarns 4 and 5) are disposed in the order that the first warp ground yarn connecting yarn forms three knuckles on the upper layer surface (the warp ground yarn connecting yarn 4) and the second warp ground yarn connecting yarn forms two knuckles (the warp ground yarn connecting yarn 5), as they are disposed. Thus, it was made into a texture in which the disposition order of the warp ground yarn connecting yarns in a pair was alternately disposed, and repeating patterns of the pairs of the warp ground yarn connecting yarns are inversed. As this example, by changing the disposition order of the warp ground yarn connecting yarns, the oblique mark appearing on the textile surface can be relieved.

The other is the same as FIG. 1, and on the upper surface side surface, one set of two warp ground yarn connecting yarns is woven together with the upper surface side weft to form a plain weave corresponding to one warp, the upper surface side warps adjacent to it is also woven together with the upper surface side wefts to form a plain weave, and the upper surface side surface forms the plain weave by two kinds of yarns in a vertical direction and the weft. Thus, it is superior in fiber supportability in which the surface is made into a fine plain weave structure, and there is even no local concave, since two warp ground yarn connecting yarns are used, it is superior also in connecting force. Since it is the texture in which one weft always passes over only either one of the upper surface side warp, or the warp ground yarn connecting yarn, by changing the kind, line diameter, or the like, of the upper surface side weft, upper surface side warp, and warp ground yarn connecting yarn, the textile surface can be made uniform. In addtion, the running surface side was also made into a weft wear type texture capable of enduring wear. Moreover, since it is made into a structure in which the running surface side knuckle of the warp ground yarn connecting yarn is disposed adjacent to the running surface side knuckle of the running surface side warp, the wear of the warp ground yarn connecting yarn whose line diameter is small can be also relieved.

Example 3

FIG. 4 is another example of the present invention. FIG. 4 is an 8-shaft two-layer textile, and the complete design view comprises four warps 3, 6, 9 and 12, and four sets of warp ground yarn connecting yarns 1 and 2, 4 and 5, 7 and 8, and 10 and 11. One set of two warp ground yarn connecting yarns is disposed between the warps. Examples 1 and 2 shown in FIGS. 1 and 3 have different textures of the warp ground yarn connecting yarns in one set. In the example 3, however, the textures of the warp ground yarn connecting yarns in one set are the same. On the textile surface, the texture of one set of two warp ground yarn connecting yarns forms a plain weave like one upper surface side warp. Concretely, the warp ground yarn connecting yarn 1 is in a texture in which it passes over one upper surface side weft 1', passes between one upper surface side weft 2' and the running surface side weft 2', passes over one upper surface side weft 3', passes between two upper surface side wefts 4' and 5' and the running surface side wefts 4' and 5', passes under one running surface side weft 6', and passes between two upper surface side wefts 7' and 8' and the running surface side wefts 7' and 8'. The texture of the warp ground yarn connecting yarn 2, which forms a pair with the warp ground yarn connecting yarn 1, passes under one running surface side weft 2', passes between two upper surface side wefts 3' and 4' and the running surface side wefts 3' and 4', passes over the upper surface side weft 5', passes between one upper surface side weft 7' and the running surface side weft 7', and passes between two upper surface side wefts 8' and 1' and the running surface side wefts 8' and 1'. Thus, on the upper layer surface side, the pair of warp ground connecting yarns form a plain weave, as if the pair is working like one warp. Likewise, as for the other warp ground yarn connecting yarns 4 and 5, 7 and 8, and 10 and 11, and as for the upper surface side warps 3, 6, 9 and 12, they are woven with the upper surface side wefts to form a plain weave on the upper surface. Like the other examples, the running surface side texture is a weft wear type. Furthermore, likewise the examples 1 and 2 of FIGS. 1 and 3, since the warp ground yarn connecting yarns 1 and 2, 4 and 5, 7 and 8, and 10 and 11 form knuckles (shown in the marks Δ) adjacent to knuckles formed by the running surface side warps 3, 6, 9 and 12 (shown in the mark ○), the wear of the small-diameter warp ground yarn connecting yarns is relieved and the use life can be elongated. In this case, the knuckles formed by the warp ground yarn connecting yarns 1 and 5 on the running surface side are adjacent to the knuckle formed by the running surface side warp 3 at the places where they are disposed under the running surface side weft 6'. The knuckles formed by the warp ground yarn connecting yarns 2 and 4 on the running surface side are adjacent to the knuckle formed by the running surface side warp 3 at the places where they are disposed under the running surface side weft 2'. The knuckles formed by the warp ground yarn connecting yarns 7 and 11 on the running surface side are adjacent to the knuckle formed by the running surface side warp 9 at the places where they are disposed under the running surface side weft 4'. The knuckles formed by the warp ground yarn connecting yarns 8 and 10 on the running surface side are adjacent to the knuckle formed by the running surface side warp 9 at the places where they are disposed under the running surface side weft 8'.

Thus, in the textile of this example, by making the surface into a fine plain weave structure, the fiber supportability is improved. There is even no local concave. By using two warp ground yarn connecting yarns, the textile superior also in connecting force can be provided. Since it is a texture in which one weft always passes over only either one of the upper surface side warp or the warp ground yarn connecting yarn, by changing the line kind and weave conditions of the upper surface side weft, upper surface side warp, and warp ground yarn connecting yarn, the textile surface can be made uniform. In addition, the running surface side was also made into a weft wear type texture capable of enduring wear. Furthermore, since it is made into a structure in which the running surface side knuckle of the warp ground yarn connecting yarn is disposed adjacent to the running surface side knuckle of the running surface side warp, the wear of the warp ground yarn connecting yarn whose line diameter is small can be relieved.

Example 4

FIG. 5 is another example of the present invention. FIG. 5 is a 16-shaft two-layer textile, and the complete design view comprises four upper surface side warps 4, 8, 12 and 16, eight running surface side warps 3 and 4, 7 and 8, 12 and 12 and, 15 and 16, and four sets of warp ground yarn connecting yarns 1 and 2, 5 and 6, 9 and 10, and 13 and 14. The complete design view also comprises 16 upper side surface wefts 1'through 16' and 16 running side surface wefts 1' through 16', which are disposed under the upper side surface wefts 1 through 16'. One set of two warp ground yarn connecting yarns is disposed between the warps, and a set of warp ground yarn connecting yarns 1 and 2, and 9 and 10 of the same texture and a set of warp ground yarn connecting yarns 5 and 6, and 13 and 14 of different textures are alternately disposed. The texture of the warp ground yarn connecting yarns of the same texture forms, on the textile surface, a plain weave like one set of two upper surface side warps. The warp ground yarn connecting yarn 1 is in a texture in which it passes under one running surface side weft 1', passes between four upper surface side wefts 2', 3', 4', and 5' and the running surface side wefts 2', 3', 4', and 5', passes over one upper surface side weft 6', passes between one upper surface side weft 7' and the running surface side weft 7', passes on the upper surface side weft 8', passes between one upper surface side weft 9' and the running surface side weft 9', passes on the upper surface side weft 10', passes between one upper surface side weft 11' and the running surface side weft 11', passes on the upper surface side weft 12' and passes between four upper surface side wefts 13', 14', 15', and 16' and the running surface side wefts 13', 14', 15', and 16'. The texture of the warp ground yarn connecting yarn 2, that forms a pair with the warp ground yarn connecting yarn 1, is in a texture in which it passes between one upper surface side weft 1' and the running surface side weft 1', passes over one upper surface side weft 2', passes between one upper surface side weft 3' and the running surface side weft 3', passes over one upper surface side weft 4', passes between four upper surface side wefts 5', 6', 7', and 8' and the running surface side wefts 5', 6', 7', and 8', passes under one running surface side weft 9', passes between four upper surface side wefts 10', 11', 12', and 13' and the running surface side wefts 10', 11', 12', and 13', passes over one upper surface side weft 14', passes between one upper surface side weft 15' and the running surface side weft 15', and passes over one upper surface side weft 16'. Similarly, the warp ground yarn connecting yarns 9 and 10 also comprise sets of the same texture.

Furthermore, the set of warp ground yarn connecting yarns 5 and 6 present adjacent to the warp ground yarn connecting yarns 1 and 2 with sandwiching the warps 3 and 4 is a set of those in different textures. The warp ground yarn connecting yarn 5 is in a texture in which it passes between three upper surface side wefts 1', 2', and 3' and the running surface side wefts 1', 2', and 3', passes under one running surface side weft 4', passes between five upper surface side wefts 5', 6', 7', 8', and 9' and the running surface side wefts 5', 6', 7', 8', and 9', passes over one upper surface side weft 10', passes between one upper surface side weft 11' and the running surface side weft 11', passes over one upper surface side weft 12', passes between one upper surface side weft 13' and the running surface side weft 13', passes over one upper surface side weft 14', passes between one upper surface side weft 15' and the running surface side weft 15', and passes over one upper surface side weft 16'. The texture of the warp ground yarn connecting yarn 6, that forms a pair with the warp ground yarn connecting yarn 5 is in a texture in which it passes between one upper surface side weft 1' and the running surface side weft 1', passes over one upper surface side weft 2', passes between one upper surface side weft 3' and the running surface side weft 3', passes over one upper surface side weft 4', passes between one upper surface side weft 5' and the running surface side weft 5', passes over one upper surface side weft 6', passes between one upper surface side weft 7' and the running surface side weft 7', passes over one upper surface side weft 8', passes between three upper surface side wefts 9', 10', and 11' and the running surface side wefts 9', 10', and 11', passes under one running surface side weft 12', and passes between four upper surface side wefts 13', 14', 15', and 16' and the running surface side wefts 13', 14', 15', and 16'. Similarly, the warp ground yarn connecting yarns 13 and 14 also form a set of yarns in different textures.

By combining such textures, on the upper layer surface side, by one set of warp ground yarn connecting yarns, a plain weave is formed like one warp.

The running surface side texture of the Example 4 is a weft wear type. The point that this example is different from the examples of FIGS. 1, 3, and 4 is that one upper surface side warp and two running surface side warps are disposed between one set of warp ground yarn connecting yarns. In the examples of FIGS. 1, 3, and 4, one running surface side warp is disposed corresponding to one upper surface side warp. In this example, another running surface side warp is added, there is an effect of improving the rigidity of the textile. The resistance against elongation is also improved. Since the running surface side warp which never appears on the upper surface side surface is disposed, the surfaceability is also not deteriorated, and a textile very superior in rigidity and so on can be provided. As shown in FIG. 5, the running surface side warps 3, 7, 11, and 15 were added to the textile.

Furthermore, as in the example of FIG. 5, it may be a structure in which the warp ground yarn connecting yarns in a set of the same texture 1 and 2, and 9 and 10, and the warp ground yarn connecting yarns in a set of different textures 5 and 6, and 13 and 14, are mixed. However, it is preferable that knuckles of the warp ground yarn connecting yarns are always formed on one upper surface side warp, and knuckles of the upper surface side warps are always present on another upper surface side warp, since the height of the knuckle of the weft can be made uniform. In the Example 4, knuckles of upper surface side wefts 1', 3', 5', 7', . . . are formed with upper surface side warps 4, 8, 12 and 16, and knuckles of upper surface side wefts 2', 4', 6', 8', . . . are formed with ones of pairs of warp ground yarn connecting yarns 1 and 2, 5 and 6, 9 and 10, and 14 and 15.

Furthermore, like the other examples, since it is made into a texture in which the warp ground yarn connecting yarn knuckle is disposed adjacent to the running surface side warp knuckle, the wear of the small-diameter warp ground yarn connecting yarn is relieved and the use life can be elongated.

Thus, in the textile of this example, by making the surface into a fine plain weave structure, the fiber supportability and surfaceability are improved by using two warp ground yarn connecting yarns, the textile superior also in connecting force can be provided. In addition, since the warp is added to the running surface side layer, it is superior in rigidity, and the resistance against elongation can be improved. Since it is a texture in which one weft always passes over only either one of the upper surface side warp or the warp ground yarn connecting yarn, by changing the line kind, another condition, and so on, of the upper surface side weft, upper surface side warp, and warp ground yarn connecting yarn, the textile surface can be made uniform. Moreover, the running surface side was also made into a weft wear type texture capable of enduring wear. In addition, since it is made into a structure in which the running surface side knuckle of the warp ground yarn connecting yarn is disposed adjacent to the running surface side knuckle of the running surface side warp, the wear of the warp ground yarn connecting yarn whose line diameter is small can be relieved.

In FIG. 6, a two-layer textile of prior art in which a plain weave texture was formed on the upper layer surface side surface by warp ground yarn connecting yarns disposed in one set of two in which an upper surface side layer and a running surface side layer were woven together with forming an upper surface side surface, and an upper surface side warp and an upper surface side weft, was shown.

In FIG. 6, although one set of two warp ground yarn connecting yarns functions as the upper surface side warp to form a plain weave on the upper surface side surface, adjacent to it, three upper surface side warps form a plain weave texture with the upper surface side weft. For making into a texture forming a plain weave as the whole of the textile surface, there is a necessity that continuous three upper surface side warps are made into a structure in which the upper surface side warps on both sides pass over the same upper surface side weft, and the upper surface side warp present between them is made into a texture in which one set of warp ground yarn connecting yarns passes over the same weft as the upper surface side weft which formed a knuckle. Concretely, in FIG. 6, one set of warp ground yarn connecting yarns 1 and 2 forms a knuckle over the upper surface side wefts 2', 4', 6', and 8' of even numbers. In contrast with it, for making the whole of the textile surface a plain weave texture, the upper surface side warp 3 adjacent to the warp ground yarn connecting yarns 1 and 2 must form a knuckle over odd numbers 1', 3', 5', and 7', and the upper surface side warp 4 adjacent to it forms a knuckle over the upper surface side wefts 2', 4', 6', and 8' of the even numbers like one set of warp ground yarn connecting yarns 1 and 2. The upper surface side warp 5 adjacent to it forms a knuckle over the odd numbers 1', 3', 5', and 7'. The warp ground yarn connecting yarns 6, 7 and 11, 12, and 16, 17 in a set also forms a knuckle over the upper surface side wefts 2', 4', 6', and 8' of the even numbers like one set of warp ground yarn connecting yarns 1 and 2 continuous upper surface side warps 8, 9, 10 and 13, 14, 15 and 18, 19, 20 are also textures in which, at the center of the warp forming a knuckle over the upper surface side wefts of even numbers like the upper surface side warps 3, 4, and 5, on both sides of it, the warp forming a knuckle over the upper surface side wefts of the odd numbers 1', 3', 5', and 7', is disposed.

When it is made into such a structure, although it is a structure in which the upper surface side warp always forms the knuckle over the upper surface side wefts of the odd numbers, over the upper surface side wefts of the even numbers, the yarns in a vertical direction of both of the warp ground yarn connecting yarn and the upper surface side warp form a knuckle. Therefore, since the knuckles in two vertical directions formed over the upper surface side wefts of the even numbers are different in tension, since the heights of the knuckles of the upper surface side wefts are different, it is impossible to give a smooth surface.

Therefore, even if the yarns in two vertical directions are present like the present invention, if it is made into a structure in which the yarn in either one vertical direction forms a knuckle over one upper surface side weft, since the tension becomes the same, the heights of the knuckles can be made substantially uniform, and it becomes possible to give a smooth surface.

The industrial multilayer textile of the present invention comprises at least an upper surface side layer, and a running surface side layer, in which one set of two warp ground yarn connecting yarns forming part of an upper surface side surface and weaving together the upper surface side layer and the running surface side layer, is disposed, those alternately appear to form a plain weave corresponding to one warp, further, by making the upper surface side layer surface into a plain weave structure by one set of two warp ground yarn connecting yarns, an upper surface side warp, and an upper surface side weft, there is an effect that it is superior in fiber supportability and connecting force, besides, by using the warp ground yarn connecting yarn in the yarn in which the connecting yarn weaving together each layer forms part of the upper surface side surface, a local concave can be eliminated, by making into a structure in which either one knuckle of the warp ground yarn connecting yarn, or the upper surface side warp is present on one weft, by changing the line material and another condition of each yarn, it is superior in surface smoothness, and it exhibits a very superior effect as other industrial textiles including a wire for papering used in a papermaking step.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

The disclosure of Japanese Patent Application No. 2001-235564 filed Jun. 29, 2001 including specification, drawings and claims is incorporated herein by reference in its entirety.

What is claimed is:

1. An industrial multilayer textile comprising:

at least an upper surface side layer and a lower surface side layer as a running surface, the upper surface side layer and the lower surface side layer being connected by warp ground yarn connecting yarns weaving between the upper surface side layer and the lower surface side layer, wherein a surface of a plain weave texture is formed on the upper surface side layer by an upper surface side warp, a pair of warp ground yarn connecting yarns, and upper surface side wefts having a first upper surface side and a second upper surface side weft, wherein the pair of warn ground yarn connecting yarns and the upper surface side warp are alternately disposed such that the first upper surface side weft passes only over the upper surface side warp to form knuckles on the upper surface side, and the second upper surface side weft passes only over the pair of warp ground yarn connecting yarns to form knuckles on the upper surface side, and wherein the first upper surface side weft and the second upper surface side weft are alternately disposed relative to each other.

2. The industrial multilayer textile according to claim 1, wherein the upper surface side warp and the warp ground yarn connecting yarn are yarns different in material.

3. The industrial multilayer textile according to claim 1, wherein each of the pair of warp ground yarn connecting yarns forms a weaving pattern in a complete texture.

4. The industrial multilayer textile according to claim 1, wherein the pair of warp ground yarn connecting yarns consists of first and second warp ground yarn connecting yarns, the first warp ground yarn connecting yarn passes under a lower surface side weft on a lateral side of a position where a lower surface side warp passes under the lower surface side weft.

5. The industrial multilayer textile according to claim 1, wherein the pair of warp ground yarn connecting yarns consists of first and second warp ground yarn connecting yarns, the first warp ground yarn connecting yarn passes over one upper surface side weft to form a knuckle on the upper surface side, passes between the next one upper surface side weft and a lower surface side weft, passes over the next one upper surface side weft to form a knuckle on the upper surface side, passes between the next two upper surface side wefts and the lower surface side wefts, and then, after passing under one lower surface side weft, passes between two upper surface side wefts and the lower surface side wefts.

6. The industrial multilayer textile according to claim 1, wherein the pair of warp ground yarn connecting yarns consists of first and second warp ground yarn connecting yarns, the first warp ground yarn connecting yarn passes over one upper surface side weft to form a knuckle on the upper surface side, passes between the next upper surface side weft and a lower surface side weft, passes over the next one upper surface side weft to form a knuckle on the upper surface side, passes between the next three upper surface side wefts and the lower surface side wefts, and then, after passing under one lower surface side weft, passes between three upper surface side wefts and the lower surface side wefts.

7. The industrial multilayer textile according to claim 6, wherein the second warp ground yarn connecting yarn passes over one upper surface side weft to form a knuckle on the upper surface side, passes between the next upper surface side weft and a lower surface side weft, passes over one next upper surface side weft to form a knuckle on the upper surface side, passes between the next upper surface side weft and a lower surface side weft, passes over the next one upper surface side weft to form a knuckle on the upper surface side, passes between the next two upper surface side wefts and the lower surface side wefts, and then, after passing under one lower surface side weft, passes between two upper surface side wefts and the lower surface side wefts.

8. The industrial multilayer textile according to claim 1, wherein said textile comprises a first pair of warp ground yarn connecting yarns having a first repeating pattern and a second pair of warp ground yarn connecting yarns having a second repeating pattern, the first repeating pattern is inverse to the second repeating pattern.

9. The industrial multilayer textile according to claim 1, wherein the pair of warp ground yarn connecting yarns consists of first and second warp ground yarn connecting yarns, the first warp ground yarn connecting yarn passes over one upper surface side weft to form a knuckle on the upper surface side, passes between the next upper surface side weft and a lower surface side weft, passes over the next one upper surface side weft to form a knuckle on the upper surface side, passes between two upper surface side wefts and the lower surface side wefts, and then, after passing under one lower surface side weft, passes between two upper surface side wefts and the lower surface side wefts.

10. The industrial multilayer textile according to claim 9, wherein the second warp ground yarn connecting yarn passes over one upper surface side weft to form a knuckle on the upper surface side, passes between the next upper surface side weft and a lower surface side weft, passes over the next one upper surface side weft to form a knuckle on the upper surface side, passes between two upper surface side wefts and the lower surface side wefts, and then, after passing under one lower surface side weft, passes between two upper surface side wefts and the lower surface side wefts.

11. The industrial multilayer textile according to claim 1, wherein the pair of warp ground yarn connecting yarns consists of first and second warp ground yarn connecting yarns, the first warp ground yarn connecting yarn passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over the next one upper surface side weft to form a knuckle on the upper surface side, passes between the next four upper surface side wefts and the lower surface side wefts, and then, after passing under one lower surface side weft, passes between four upper surface side wefts and the lower surface side wefts.

12. The industrial multilayer textile according to claim 11, wherein the second warp ground yarn connecting yarn passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over the next one upper surface side weft to form a knuckle on the upper surface side, passes between the next four upper surface side wefts and the lower surface side wefts, and then, after passing under one lower surface side weft, passes between four upper surface side wefts and the lower surface side wefts.

13. The industrial multilayer textile according to claim 1, wherein the pair of warp ground yarn connecting yarns consists of first and second warp ground yarn connecting yarns, the first warp ground yarn connecting yarn passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over the next one upper surface side weft to form a knuckle on the upper surface side, passes between the next three upper surface side wefts and the lower surface side wefts, and then, after passing under one lower surface side weft, passes between five upper surface side wefts and the lower surface side wefts.

14. The industrial multilayer textile according to claim 13, wherein the second warp ground yarn connecting yarn passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over one upper surface side weft to form a knuckle on the upper surface side, passes between the next upper surface side weft and a lower surface side weft, passes over the next one upper surface side weft to form a knuckle on the upper surface side, passes between the next three upper surface side wefts and the lower surface side wefts, and then, after passing under one lower surface side weft, passes between five upper surface side wefts and the lower surface side wefts.

* * * * *